US006357850B1

(12) United States Patent
Liu

(10) Patent No.: US 6,357,850 B1
(45) Date of Patent: Mar. 19, 2002

(54) METHOD FOR INDICATING ACCURACY OF MEDIA ADVANCEMENT

(75) Inventor: Chen Liu, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/618,403

(22) Filed: Jul. 18, 2000

(51) Int. Cl.[7] ..... B41J 29/393; B41J 29/38
(52) U.S. Cl. ..... 347/19; 347/14
(58) Field of Search ..... 347/19, 16, 22, 347/23, 14, 40, 41, 43, 104, 101, 105, 17

(56) References Cited

U.S. PATENT DOCUMENTS 5,448,269 A * 9/1995 Beauchamp et al. ..... 347/19
5,831,644 A * 11/1998 Kato ..... 347/22

* cited by examiner

*Primary Examiner*—John Barlow
*Assistant Examiner*—Charles W. Stewart, Jr.

(57) ABSTRACT

A method for detecting accuracy of media advancement is disclosed. A first set of nozzles of a printhead imprints a first swath of prints on a media sheet. After the media sheet is advanced by a predetermined distance, a second set of nozzles located in front of the first set of nozzles in the direction of the media advancement imprints a second swath of prints on the media sheet. The degree of the alignment of these two swaths of prints then serves as an accuracy factor of the media advancement and the accuracy factor can then be ascertained.

12 Claims, 4 Drawing Sheets

METHOD FOR INDICATING ACCURACY OF MEDIA ADVANCEMENT

BACKGROUND OF THE INVENTION

This invention relates generally to inkjet printers, and more particularly to the calibration of a media feed system of an inkjet printer.

A media feed system of an inkjet printer refers to the overall mechanical system of the printer that feeds a media sheet to a print zone for imprinting images on the media sheet. Basically, the media feed system includes a drive roller for feeding a media sheet towards the print zone and, in some printers, for picking the media sheet from a media bin before feeding.

Inaccurate advancement of the media sheet, namely, the media sheet being advanced less or more than expected, will inevitably result in poor quality of printing, especially for multi-color, multi-pen inkjet printers.

Conventionally, an optical equipment is used to scan certain predefined print pattern for detecting the inaccuracy of media advancement. Nevertheless, such equipment may be unnecessarily expensive, and further increase the cost of the printer. Moreover, the optical equipment may only allow off-line measurement to ensure the quality of media feed system. Therefore, a user can not re-calibrate the media feed system when the accuracy degrades.

Therefore, there is a need for a convenient way for measuring the accuracy of media advancement and compensating the inaccuracy, if any, by an end user.

SUMMARY OF THE INVENTION

Hereinafter, it is presumed that each nozzle of a printhead is evenly spaced along a media scan axis and that the vertical distance, namely, the distance along the media scan axis, between each nozzle is fixed. If the advancement of a media sheet is accurate, then lines imprinted on the media sheet by two nozzles will be aligned if the media sheet is advanced by a distance the same as the vertical distance between these two nozzles and if the second line is printed after such an advancement.

According to one aspect of the invention, in a printer having a printhead, in a preferred embodiment of a method for indicating the accuracy of media advancement, a first set of nozzles of the printhead imprints a first swath of prints on a media sheet. After the media sheet is advanced by a predetermined distance in the printer, a second set of nozzles located in front of the first set of nozzles in the direction of the media advancement imprints a second swath of prints on the media sheet. The degree of the alignment of these two swaths of prints serves as an accuracy factor of the media advancement and the accuracy factor can then be ascertained.

The accuracy of the media advancement can be further determined based upon the accuracy factor.

In a preferred embodiment, each swath of prints includes a plurality of lines that are orthogonal to the direction of the media advancement.

Ideally, the first set of nozzles has a primary nozzle for printing the first swath of prints, and the second set of nozzles has a center nozzle and other nozzles of the second set are located at both sides of the center nozzle. The distance along a media scan axis between the primary nozzle and the center nozzle is the same as the predetermined distance of media advancement.

It is preferred that the second swath of prints is in a staircase pattern.

According to a further aspect of the invention, the media feed system is subsequently adjusted based upon the accuracy factor.

DETAILED DESCRIPTION OF THE INVENTION

Figure 1:
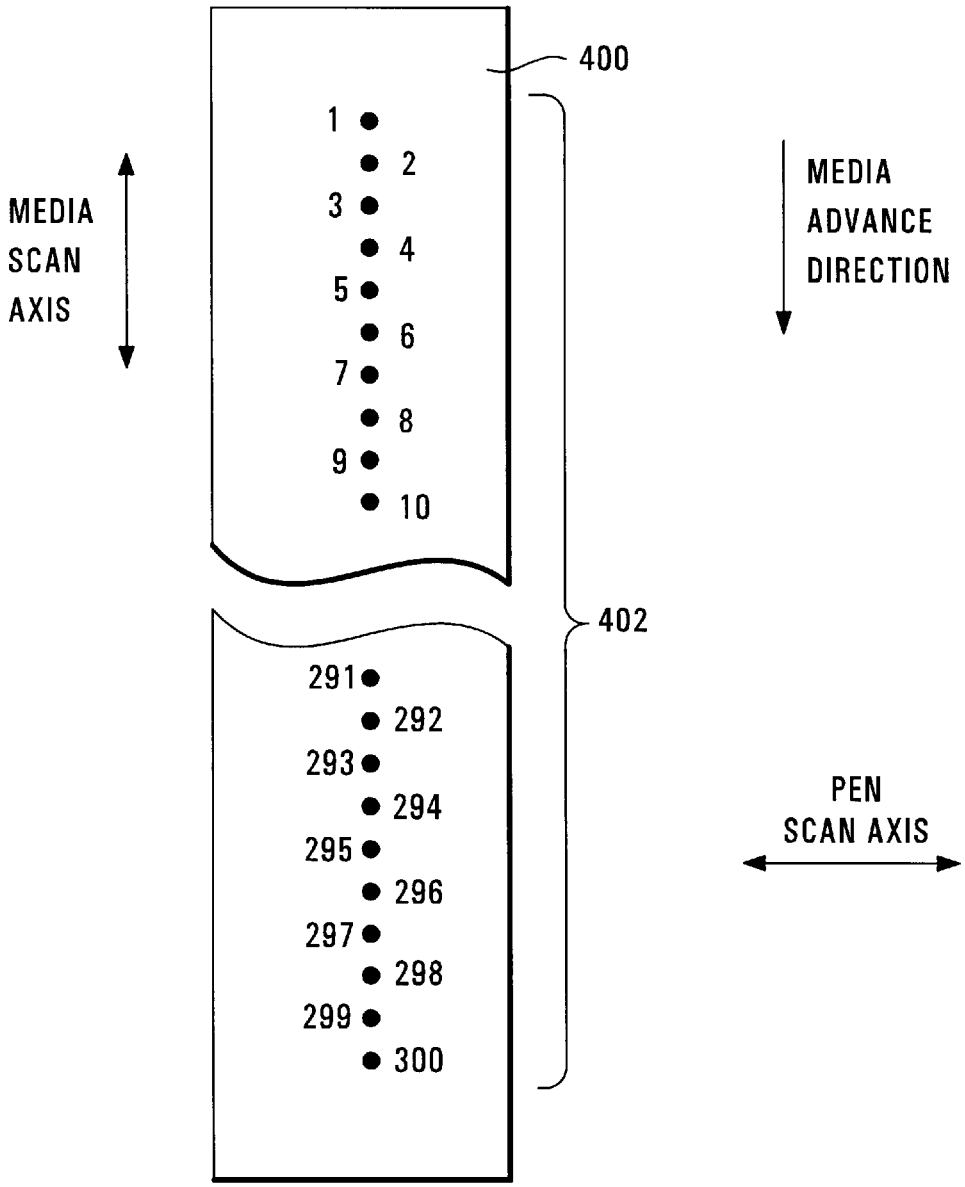
FIG. 1 illustrates an example of an orifice plate and a nozzle array of an inkjet printer.

In an inkjet printer, to provide a pen body having an ink reservoir section containing a supply of ink is known (not shown). The pen has a snout with a printhead. The printhead includes an orifice plate 400, with a nozzle array 402 thereon. FIG. 1 shows an illustrative example of the orifice plate 400 and the nozzle array 402 that may be used in the current invention. As illustrated, the printhead has three hundred nozzles 1–300 spaced at 1/600-inch. Ink drops are ejected onto a media sheet through these nozzles during printing.

A media scan axis as shown in FIG. 1 will be used as a reference for displacement of the media sheet, as well as a reference for orientation of a line. The media scan axis can be considered as being generally tangential to the media sheet surface that is below the nozzles and orthogonal to the pen scan axis. The media scan axis is conveniently called the "vertical" axis. Also, the pen scan axis is conveniently called the "horizontal axis." Accordingly, in the following description, printed lines aligned with the pen scan axis will be called "horizontal" lines.

As illustrated, nozzles 1–300 are numbered in accordance with the direction of media advancement. Furthermore, the difference between the numbers of two nozzles reflects the vertical distance, namely, the distance along the media scan axis, between these two nozzles. For example, the vertical distance between nozzle 50 and nozzle 250 is 200 times 1/600-inch.

With reference to FIG. 1, a preferred embodiment of the method for indicating the accuracy of media advancement will now be described in detail.

Figure 2:
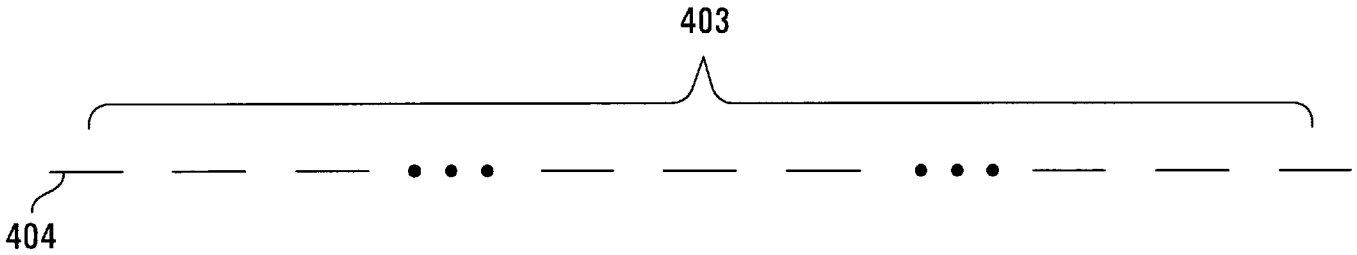
FIG. 2 illustrates a first swath of lines printed by a primary nozzle.

In a first step, a first print such as a first swath of aligned horizontal lines 403 as illustrated in FIG. 2 is imprinted on the media sheet by a primary nozzle, e.g., nozzle 50, and with pen movement rather than media movement. In the preferred embodiment, the first swath 403 has 15 lines with the same length of approximately 3 millimeters. A fixed internal horizontal distance between each line, e.g., approximately 6 millimeters, is chosen to fit these 15 lines onto an A4 size media sheet.

In a second step, the media sheet is advanced by a predetermined distance, e.g., 1/3-inch, along the media advance direction. The predetermined distance is selected to be not more than the maximum vertical distance between the nozzles of the printhead, that is, in this case, the vertical distance between nozzle 1 and nozzle 300.

Figure 3:
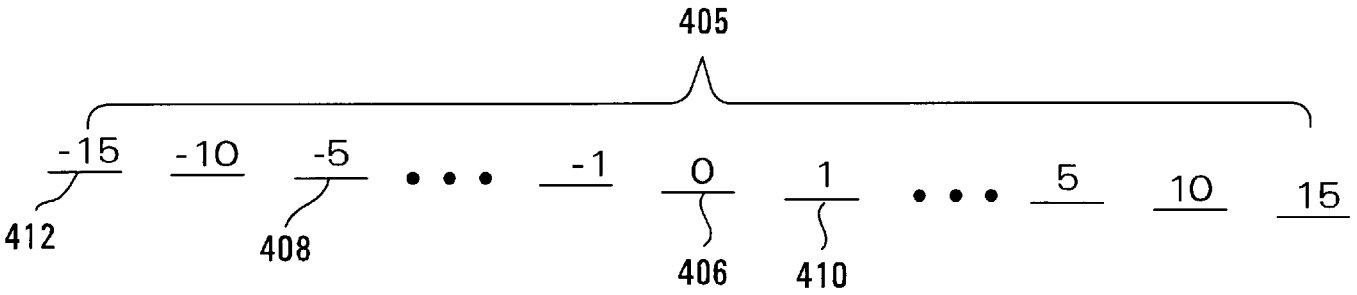
FIG. 3 illustrates a second swath of lines printed by a second set of nozzles.

In a third step of, a second print such as a second swath of horizontal lines 405 as illustrated in FIG. 3 is imprinted on the media sheet by a second set of nozzles, i.e., nozzles 235, 240, 245–255, 260 and 265, and with pen movement rather than media movement. As shown in FIG. 1, the second set of nozzles is located in front of the primary nozzle in the direction of the media advancement. Among the second set of nozzles, there is a center nozzle, i.e., nozzle 250, and other nozzles of the second set are located at both sides of the center nozzle 250. The center nozzle is determined according to the predetermined distance in the second step of the invention. Particularly, the vertical distance between the primary nozzle, i.e., nozzle 50 as in the preferred embodiment, and the center nozzle, i.e., nozzle 250, is the same as the predetermined distance, i.e., ⅓-inch.

As illustrated, the second swath 405 has 15 lines and is arranged in a staircase pattern. Each line of the second swath 405 is placed below the preceding line vertically but horizontally offset by a fixed-internal distance from a line 412 at the left end. In the preferred embodiment, each line of the second swath 405 has the same length as the first swath of lines 403, i.e., approximately 3 millimeters; the internal horizontal distance between each line of the second swath 405 is the same as the first swath 403, i.e., approximately 6 millimeters. Moreover, line 412 at the left end of the second swath 405 is horizontally spaced approximately 1/600-inch away from a line 404 at the left end of the first swath 403.

Figure 4:
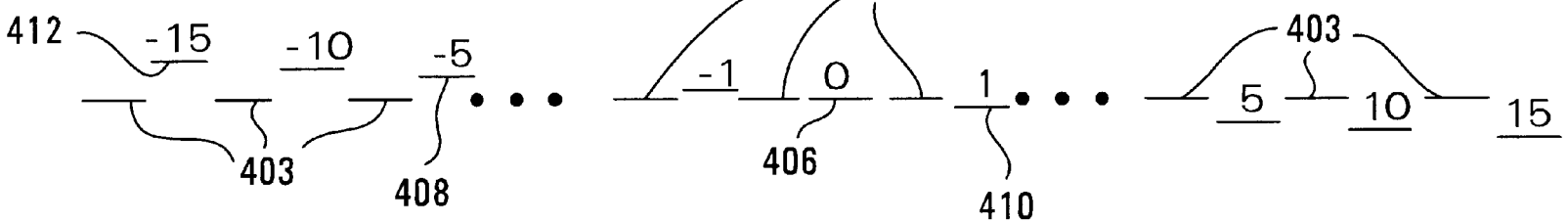
FIG. 4 illustrates an alignment of the two swaths of lines in an ideal media advancement situation.

The prints can also be designed to include some wordings, like indications regarding the accuracy of paper advancement, such as "0", "5", "−5" etc, as shown in FIGS. 3 and 4. In the preferred embodiment, each of these numbers is placed above one of the 15 lines of the second swath 405. Each line of the second swath 405 is printed by using a different nozzle, and the number above is determined by the difference between the numbers of the center nozzle and the nozzle printing this line. For example, line 406 is printed by nozzle 250. Since the difference between the numbers of this nozzle and the center nozzle, i.e., nozzle 250, is zero, line 406 is numbered "0." Similarly, line 408 printed by nozzle 245 is numbered "−5," while line 410 printed by nozzle 251 is numbered "1."

The vertical distance between each line of the second swath 405 is determined by the vertical distance between each nozzle printing the lines. Since each line is printed by a single nozzle and with pen movement, i.e., the movement of such a single nozzle, rather than media movement, the vertical distance between two lines is the same as the vertical distance between the two nozzles that print these two lines respectively. Therefore, the vertical distance between line 412 printed by nozzle 235 and line 408 printed by nozzle 245 is 10 times 1/600-inch, that is, 1/60-inch. Similarly, the vertical distance between line 408 and line 406 is 1/120-inch, and so on.

The actual prints on the media sheet after the preceding three steps look like what is shown in FIG. 4. FIG. 4 illustrates an alignment of the two swaths in an ideal media advancement situation, that is, when the media advancement is accurate. As illustrated, in the ideal media advancement situation, line 406 numbered "0" and the first swath 403 are aligned. Otherwise, a line marked with another number and the first swath 403 will be aligned. For example, if the media advancement is 5*1/600-inch less, line 408 numbered "−5" and the first swath 403 will be aligned, and an accuracy factor of "−5" is obtained. If the media advancement is 1*1/600-inch more than expected, however, line 410 numbered "1" and the first swath 403 will be aligned, and an accuracy factor of "1" is obtained. Therefore, the degree of the alignment of the two swaths serves as the accuracy factor of the media advancement, and reflects the accuracy of such media advancement.

It is noted that in the preferred embodiment, such an accuracy factor only reflects the accuracy pertaining to (1) a fixed amount of media advancement, which is ⅓-inch in this case; and (2) a particular region on the circumference of the drive roller.

In the preferred embodiment, the driver roller is four inches in circumference. To ascertain the accuracy of the media advancement by such a driver roller, the preceding steps are repeated consecutively for 12 times so as to cover the whole circumference of the driver roller. Twelve accuracy factors can then be obtained by observing the degree of alignment of each group of two swaths. These 12 accuracy factors reflect respectively the accuracy of media advancement of 12 different consecutive regions on the whole circumference of the drive roller. The accuracy of the media advancement by such a drive roller in one round can then be determined by adding up the 12 accuracy factors. In certain circumstances, such as when no eccentricity error has been made during manufacturing, such an accuracy can also be ascertained roughly by 12 times one accuracy factor obtained by observing the degree of alignment of two swaths such as 403 and 405, or two times the result of adding up six accuracy factors.

It is understood that prints of different patterns, such as broken lines, or shorter/longer lines, can be used on condition that the first swath is printed by a single nozzle and each print of the second swath is printed by a different nozzle, and both with pen movement rather than media movement.

It is also understood that the patterns of the prints in the first step and the third step can be exchanged.

Figure 5:
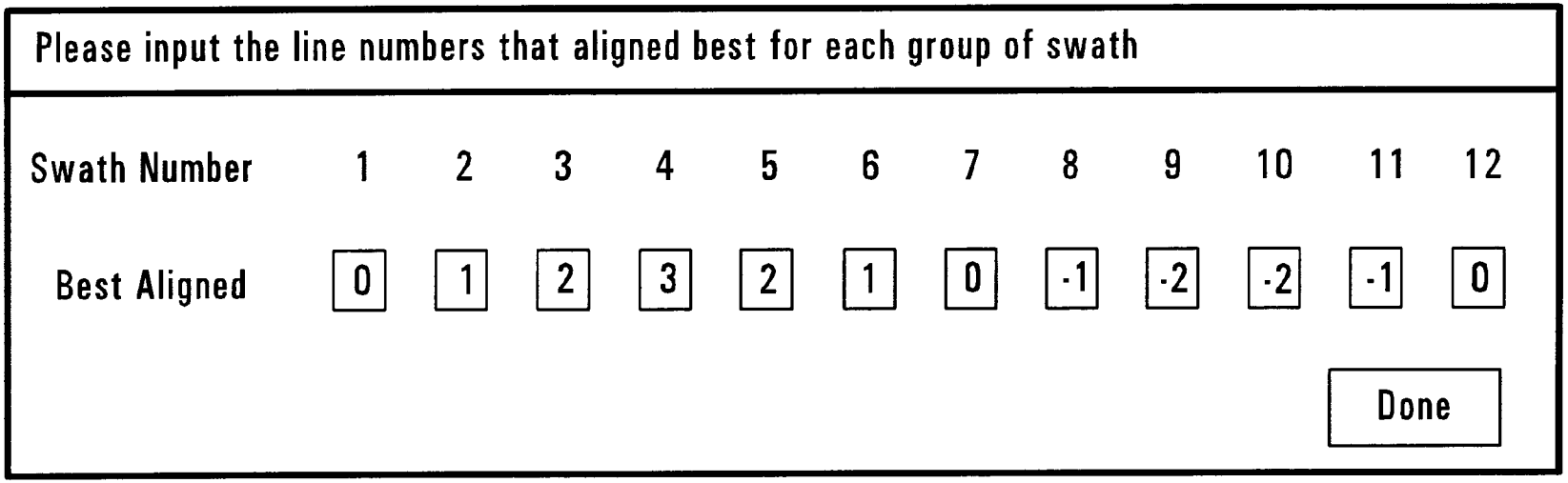
FIG. 5 illustrates a printer driver dialog box through which accuracy factors can be manually input.

According to a further aspect of the invention, the accuracy factors indicating the accuracy of media advancement can be manually input by using a dialog box displayed in a computer (see FIG. 5). In the preferred embodiment, the printer has a driver roller as the media feed system. The circumference of the drive roller is divided into 12 regions, for each of which an accuracy factor is determined according to the method for indicating the accuracy of the media advancement such that a whole circumference of the driver roller is covered. The 12 accuracy factors thus obtained are manually input into the dialog box as shown in FIG. 5, and are then passed to the printer for adjusting its media advancement accordingly. Subsequently, the printer adjusts its media feed system by respectively adjusting the advancement of each region on the circumference of the drive roller according to each corresponding accuracy factor. Take FIG. 5 for example, no adjustment is needed for region 1 which corresponds to swath 1, while −1*1/600-inch adjustment is needed for region 2 which corresponds to swath 2 since the media is overfed in that region, and so on forth.

In another embodiment according to the invention of calibrating the media feed system, a correction factor is roughly obtained by adding up the 12 accuracy factors. In such a case as shown in FIG. 5, a positive correction factor of 3*1/600-inch is determined. The correction factor is further passed to the printer that has a drive roller as the media feed system. Subsequently, the printer adjusts its media feed system by reducing the advancement of the driver roller by, in this case, 3*1/600-inch per circumference. It is understood that interpolation may be used for determining the correction factor.

What is claimed is:

1. In a printer having a printhead, a method for indicating the accuracy of media advancement, the printhead having a first set of nozzles and a second set of nozzles located in front of the first set in a direction of media advancement, comprising the steps of:

the first set of nozzles generating a first swath of prints on a media sheet;

after generating said first swath, advancing the media sheet in the printer by a predetermined distance;

after advancing the media sheet, the second set of nozzles generating a second swath of prints on the media sheet; and illustrating the degree of alignment of the two swaths of prints so as to indicate an accuracy factor of the media advancement.

2. The method of claim 1, further comprising the step of determining the accuracy of the media advancement based upon the accuracy factor.

3. The method of claim 1, wherein each swath of prints includes a plurality of lines that are orthogonal to the direction of the media advancement.

4. The method of claim 1, wherein the first set of nozzles has a primary nozzle for printing the first swath of prints, the second set of nozzles has a center nozzle, and the distance along a media scan axis between the primary nozzle and the center nozzle is the same as the first predetermined distance.

5. The method of claim 4, wherein each print of the second swath is printed by a different nozzle of the second set of nozzles and with printhead movement.

6. A method for indicating the accuracy of media advancement in a printer, comprising:

generating a first swath of lines on a medium by a first set of nozzles of a printhead of the printer;

advancing the medium in the printer by a predetermined distance after generating the first swath;

after advancing the medium, generating a second swath of lines on the medium by a second set of nozzles of the printhead located in front of the first set of nozzles in a direction of media advancement, wherein the second swath of lines is in a staircase pattern and is generated by forming each line of the second swath by a different nozzle of the second set of nozzles; and horizontally offsetting said each line by a distance; and illustrating the degree of alignment of the two swaths of lines so as to indicate an accuracy factor of the media advancement.

7. In a printer having a printhead, a method for calibrating a media feed system, the printhead having a first set of nozzles and a second set of nozzles located in front of the first set in a direction of media advancement, comprising the steps of:

the first set of nozzles imprinting a first swath of patterns on a media sheet;

after imprinting said first swath, advancing the media sheet in the printer by a predetermined distance;

after advancing the media sheet, the second set of nozzles imprinting a second swath of patterns on the media sheet;

obtaining an accuracy factor according to the degree of alignment of the two swaths of patterns; and adjusting the media feed system based upon the accuracy factor.

8. The method of claim 7, wherein each swath of prints includes a plurality of lines that are orthogonal to the direction of the media advancement.

9. The method of claim 7, wherein the first set of nozzles has a primary nozzle for printing the first swath of prints, the second set of nozzles has a center nozzle, and the distance along a media scan axis between the primary nozzle and the center nozzle is the same as the second predetermined distance.

10. The method of claim 9, wherein each print of the second swath is printed by a different nozzle of the second set of nozzles and with printhead movement.

11. The method of claim 7, the media feed system having a driver roller for feeding the media sheet, the method further comprising the step of obtaining a plurality of accuracy factors so as to cover a whole circumference of the driver roller, wherein the media feed system is adjusted based upon the plurality of accuracy factors.

12. A method for calibrating a media feed system of a printer, comprising:

printing a first swath of lines on a medium by a first set of nozzles of a printhead of the printer;

advancing the medium in the printer by a predetermined distance after printing the first swath;

after advancing the medium, printing a second swath of lines on the medium by a second set of nozzles of the printhead located in front of the first set of nozzles in a direction of media advancement, wherein the second swath of lines is in a staircase pattern and is generated by forming each line of the second swath by a different nozzle of the second set of nozzles; and horizontally offsetting said each line by a distance;

obtaining an accuracy factor according to a degree of alignment of the two swaths of lines; and adjusting the media feed system based upon the accuracy factor.

* * * * *